US009170563B2

(12) United States Patent
Rudaz et al.

(10) Patent No.: US 9,170,563 B2
(45) Date of Patent: Oct. 27, 2015

(54) TIMEPIECE COMPRISING A WINDING MECHANISM AND AT LEAST ONE MECHANISM FOR CORRECTING AT LEAST ONE INDICATOR MEMBER

(75) Inventors: Denis Rudaz, Segny (FR); Pierre Villaret, Villy le Pelloux (FR)

(73) Assignee: ROLEX S.A., Geneva (CH)

( * ) Notice: Subject to any disclaimer, the term of this patent is extended or adjusted under 35 U.S.C. 154(b) by 17 days.

(21) Appl. No.: 14/124,962

(22) PCT Filed: Jun. 21, 2012

(86) PCT No.: PCT/EP2012/061936

§ 371 (c)(1),
(2), (4) Date: Feb. 7, 2014

(87) PCT Pub. No.: WO2012/175595

PCT Pub. Date: Dec. 27, 2012

(65) Prior Publication Data

US 2014/0177397 A1 Jun. 26, 2014

(30) Foreign Application Priority Data

Jun. 21, 2011 (EP) ..... 11405272

(51) Int. Cl.
*G04B 19/24* (2006.01)
*G04B 27/04* (2006.01)

(52) U.S. Cl.
CPC ..... *G04B 27/04* (2013.01); *G04B 19/24* (2013.01); *Y10T 29/49581* (2015.01)

(58) Field of Classification Search
CPC .. G04B 19/24; G04B 27/04; G04B 19/24306; G04B 19/24313
USPC ..... 368/28, 31–32, 27, 35, 37
See application file for complete search history.

(56) References Cited

U.S. PATENT DOCUMENTS

| | | | | |
|---|---|---|---|---|
| 503,502 | A * | 8/1893 | Stark | 368/193 |
| 3,611,703 | A * | 10/1971 | Borel | 368/27 |
| 3,668,864 | A | 6/1972 | Miyasaka | |
| 3,756,015 | A * | 9/1973 | Saito et al. | 368/22 |
| 3,765,162 | A * | 10/1973 | Ushiyama et al. | 368/22 |
| 3,828,546 | A * | 8/1974 | Saito et al. | 368/22 |
| 2009/0010109 | A1 | 1/2009 | Graemiger et al. | |
| 2011/0242947 | A1 | 10/2011 | Graemiger et al. | |

FOREIGN PATENT DOCUMENTS

| | | | |
|---|---|---|---|
| CH | 432389 | A | 9/1967 |
| EP | 2012199 | A2 | 1/2009 |

OTHER PUBLICATIONS

International Search Report of PCT/EP2012/061936, mailing date of Jan. 15, 2013.

* cited by examiner

*Primary Examiner* — Sean Kayes
(74) *Attorney, Agent, or Firm* — Westerman, Hattori, Daniels & Adrian, LLP

(57) ABSTRACT

The invention relates to a horological device, in particular a horological movement or timepiece, comprising a winding mechanism and at least one mechanism for correcting at least one indicator member. According to the invention, the aforementioned mechanisms can be actuated by a control stem that can occupy at least two axial positions, each corresponding to the actuation of one of the mechanisms, said control stem (T) comprising: a winder pinion (5) that can engage with the winding mechanism; and a sliding pinion (6) that can be moved axially, both with respect to the control stem (T) and with respect to the frame of the horological device, and can engage with the correcting mechanism.

30 Claims, 7 Drawing Sheets

Figure 1:
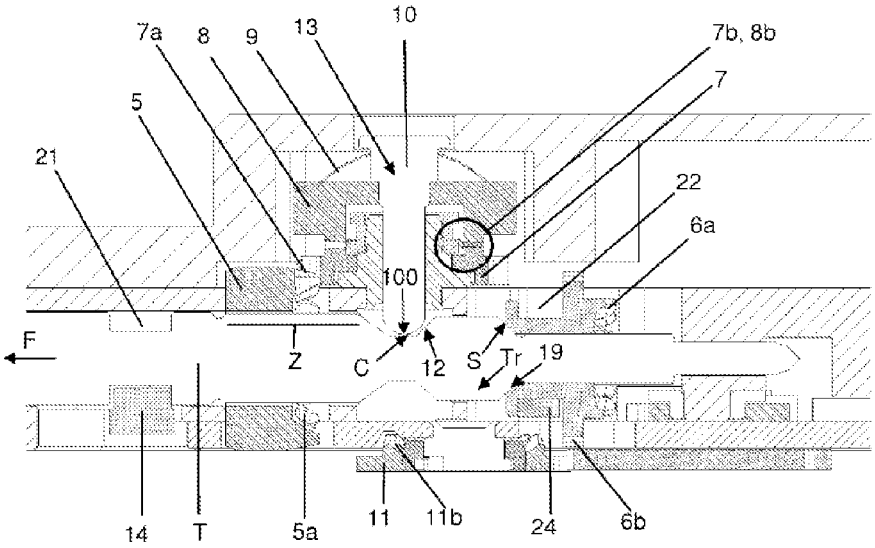

TIMEPIECE COMPRISING A WINDING MECHANISM AND AT LEAST ONE MECHANISM FOR CORRECTING AT LEAST ONE INDICATOR MEMBER

The invention relates to a horological device, in particular a horological movement or a timepiece, comprising at least two mechanisms, namely, a winding mechanism and at least one mechanism for correcting at least one indicator member.

BACKGROUND TO THE INVENTION

Timepieces comprising a winding mechanism and a mechanism for correcting indicator members are already familiar.

By way of example, the object of the European Patent Application published under reference number EP 1 152 303 is such a timepiece, in which the control stem may occupy three axial positions and includes a sliding pinion provided with rear teeth and front teeth.

In the first of the axial positions, the control stem actuates the winding mechanism by means of the rear teeth of the sliding pinion.

In its second axial position, the control stem drives the mechanism for correcting the calendar and the day, likewise by means of the rear teeth of the sliding pinion.

In its third axial position, the control stem actuates the mechanism for correcting the hour by means of the front teeth of the sliding pinion.

In this device, the winding pinion is mounted in a freely rotatable manner on the control stem. Each mechanism is actuated by at least one horizontal coupling-clutch. The timepiece utilizes the same number of levers, arranged in a plane parallel to that of the frame of the timepiece, as there are mechanisms to actuate.

This device makes it possible to eliminate any risks of unintentional correction of the calendar or the day of the week during the transition from the first to the second axial position of the stem.

However, it suffers from the major disadvantage that it does not address the associated risk of blockage during the transition from the first to the second axial position of the stem when the winding train is under tension. In addition, it needs a large number of levers and requires a sizeable surface area in order to arrange them in the plane of the timepiece.

Document CH 432389 has as its object a winding mechanism and a hand-setting mechanism that is equipped with two separate horizontal coupling-clutch devices.

The first coupling-clutch is dedicated to the winding function, and the second is provided in order to control the translation of the sliding pinion in such a way as to activate or deactivate the kinematic hand-setting train. Unlike the mechanism disclosed in document EP 1 152 303, the sliding pinion is not provided for the purpose of coming into engagement with the winding train by means of the winding pinion. Each coupling-clutch is equipped with a lever with bistable functionality, which is arranged in a plane parallel to that of the frame of the timepiece, and which is controlled directly by the setting lever. A first position of one or other of the two levers corresponds to an activation position for the function that is associated with it, while a second position corresponds to a deactivation position. Thus, it is not possible to add a third correction function such as setting a derivative indication of the time without incorporating an additional coupling-clutch device. In addition, this mechanism requires a sufficiently sizeable surface area in the plane of the timepiece to permit more than one lever to be arranged there.

Document EP2012199 relates to a mechanism with two positions. This mechanism is intended to equip a watch provided with a large number of time indications requiring correction. The first position is that for winding, whereas the second position corresponds to setting the selected indication by means of a selector member. This device utilizes a single pinion, which is in a fixed rotational connection with the stem. Its front teeth are in engagement with the different correction trains, whereas its contrate teeth are linked kinematically to the winding train. This pinion does not move axially, and the risks of over-center interference and blocking attributable to the translation of the sliding pinion are therefore overcome. The activation of the winding train is effected by means of a vertical coupling-clutch that is controlled directly by the geometry of the stem, whereas the device for selecting the indication to be corrected makes use of a selection cam intended to control the same number of coupling-clutch levers, moving parallel to the plane of the frame of the movement, as there are indications requiring correction. Such a device thus makes it possible to counter the aforementioned functional defects. However, this calls for a considerable number of levers and a sizeable surface in the plane of the timepiece sufficient to permit the arrangement of these levers, and necessarily requires the provision of a member adjacent to the stem for selecting the indication for correction.

SUMMARY DESCRIPTION OF THE INVENTION

The primary object of the invention is to propose a timepiece comprising at least two mechanisms, namely, a winding mechanism and a mechanism for correcting at least one indicator member, and which does not exhibit the aforementioned disadvantages, while possessing a more simple, more compact, more rational structure and consisting of a more limited number of parts, and while possessing the advantage of being able to add at least a second correction function for at least one indicator member without the need for an additional lever.

The said object is accomplished by a horological device, in particular a timepiece, comprising a winding mechanism and at least one mechanism for correcting at least one indicator member, these mechanisms being capable of being actuated by a control stem that can occupy at least two axial positions, each corresponding to the actuation of one of the mechanisms, this control stem comprising:

- a winding pinion that can engage with a first mechanism and
- a sliding pinion that can be moved axially, both with respect to the control stem and with respect to the frame of the horological device, and can engage with at least a second mechanism, said horological device possessing the particular feature that the winding pinion is in a fixed rotational connection with the control stem. Thus, a single lever arranged in a plane parallel to that of the frame of the timepiece is necessary for the actuation of the at least second mechanism.

Thanks to this particular feature, the transition from the actuation of one mechanism to the actuation of another mechanism can take place without the risk of blockage.

Various embodiments of the horological device are defined as follows:

- the sliding pinion is in a fixed rotational connection with the control stem;
- the winding pinion can be moved axially with respect to the control stem but is in a fixed translational connection with the frame of the horological device;

the sliding pinion exhibits contrate teeth capable of engaging with the second mechanism;

the first mechanism is actuated by coupling-clutch, in particular by a vertical coupling-clutch, in particular by a coupling-clutch that is perpendicular to the longitudinal axis of symmetry of the control stem;

the coupling-clutch comprises a sliding arbor arranged in such a way as to exhibit a lower axial extremity in contact with the control stem, and as to be capable of being displaced axially by the latter, thanks to a concavity formed by a reduction in the diameter thereof, this sliding arbor being integral with a first crown wheel in connection with the first mechanism;

the first crown wheel is capable of being driven in rotation by a second crown wheel engaging continuously with the winding pinion;

the control stem comprises a portion situated between the concavity and the sliding pinion, and of which a surface is provided to act as an axial abutment for the sliding pinion;

the control stem is dimensioned in such a way that, when the free lower axial extremity of the sliding arbor is present in the concavity, the surface prevents the sliding pinion from coming into engagement with an intermediate wheel in engagement with the second mechanism;

the control stem is dimensioned in such a way that, when it occupies its second axial position, the surface retains the sliding pinion in engagement with a/the intermediate wheel in engagement with the second mechanism;

a third mechanism is likewise capable of being actuated by the control stem;

the third mechanism is capable of being driven by the sliding pinion;

the sliding pinion exhibits contrate teeth capable of engaging with the second mechanism, and the third mechanism is capable of being driven by the contrate teeth of the sliding pinion;

the third mechanism is capable of being driven by front teeth provided on the sliding pinion;

the transition from the first mechanism to the second and, where appropriate, from the second to the third, takes place by means of a single lever;

the first mechanism is a winding mechanism, the second mechanism is a mechanism for correcting at least one first indicator member and, where appropriate, the third mechanism is a second mechanism for correcting at least another indicator member;

the second mechanism is a mechanism for setting the calendar and/or the day of the week, and/or the third mechanism is a mechanism for setting the hour;

the second mechanism is a mechanism for setting a time zone, and/or the third mechanism is a mechanism for setting the hour; and/or the correction mechanism is in the form of a correction module.

A method of manufacturing such a timepiece includes a stage in the course of which a correction module is assembled on the movement of the timepiece.

Figure 2:
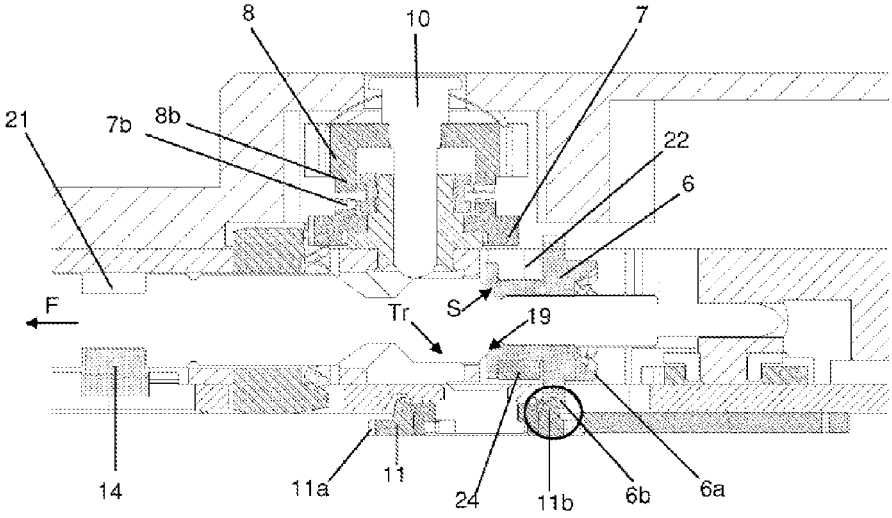
Figure 3:
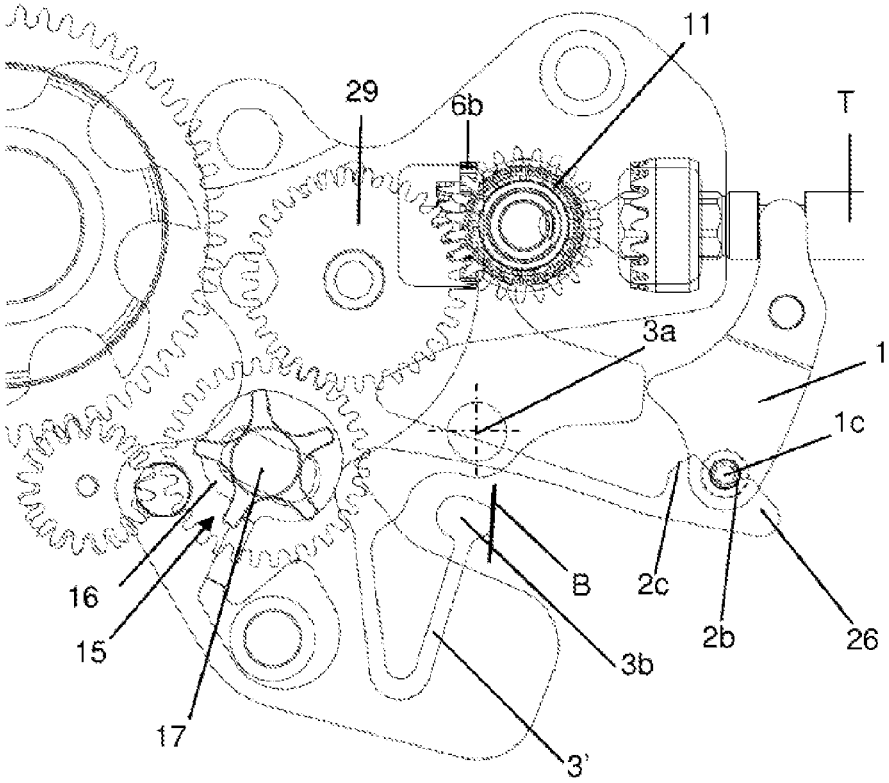
Figure 4:
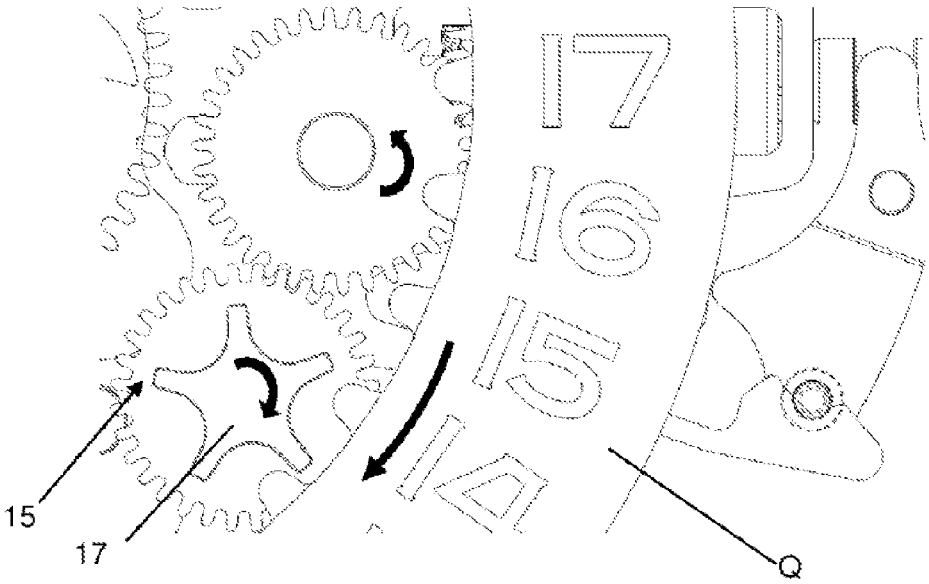
Figure 5:
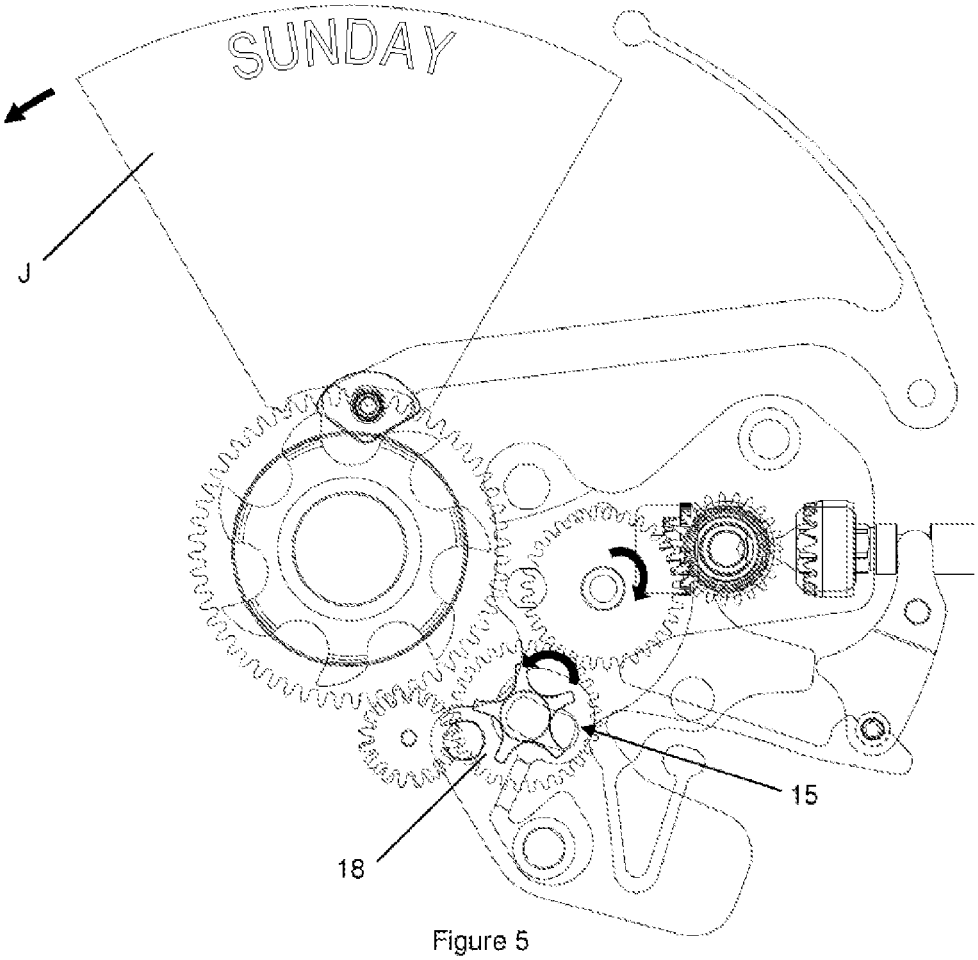
Figure 6:
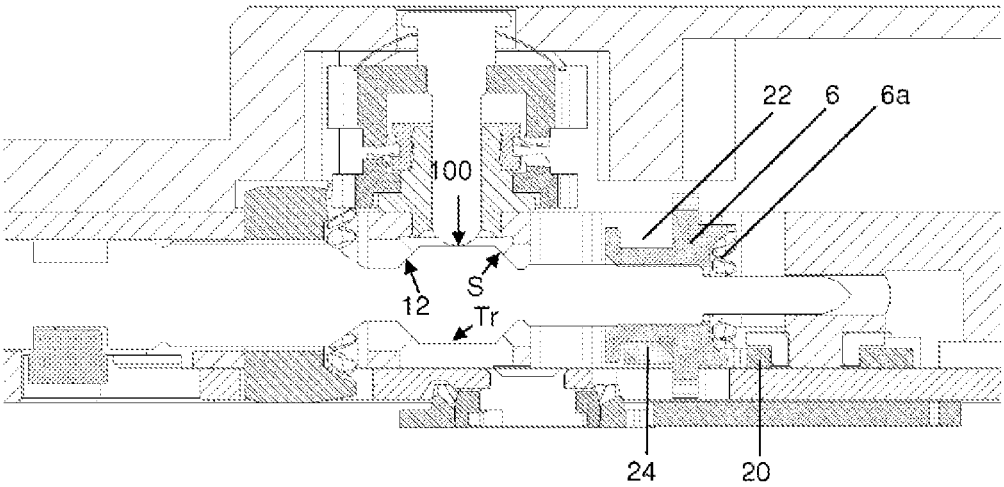
Figure 7:
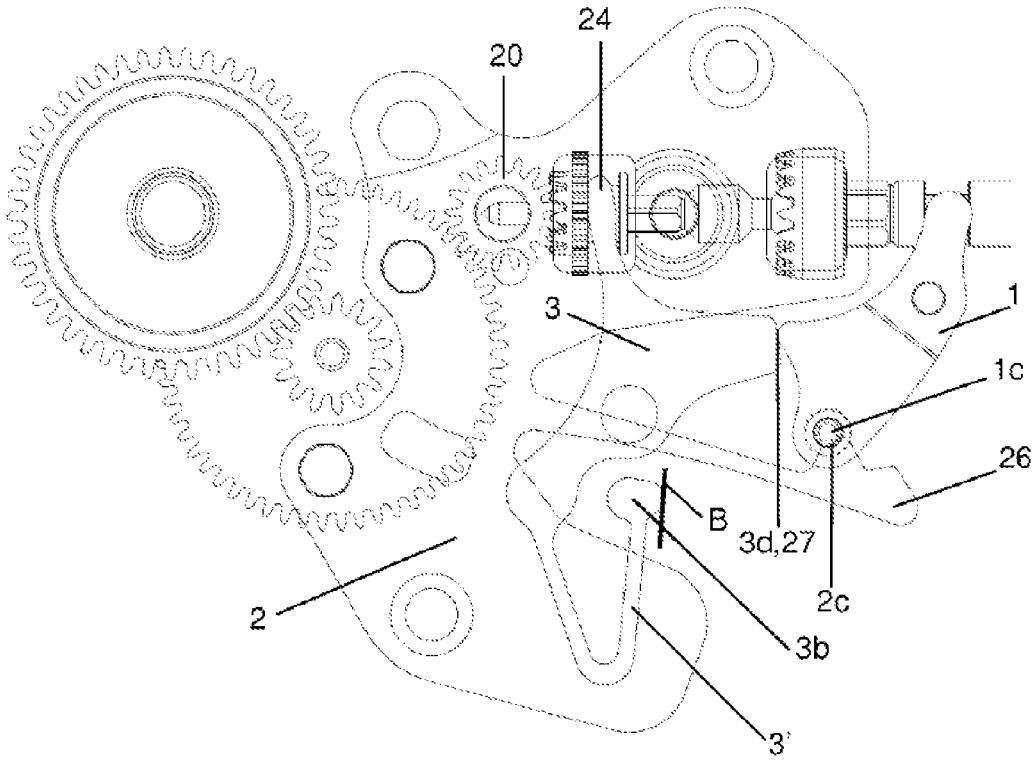
Figure 8:
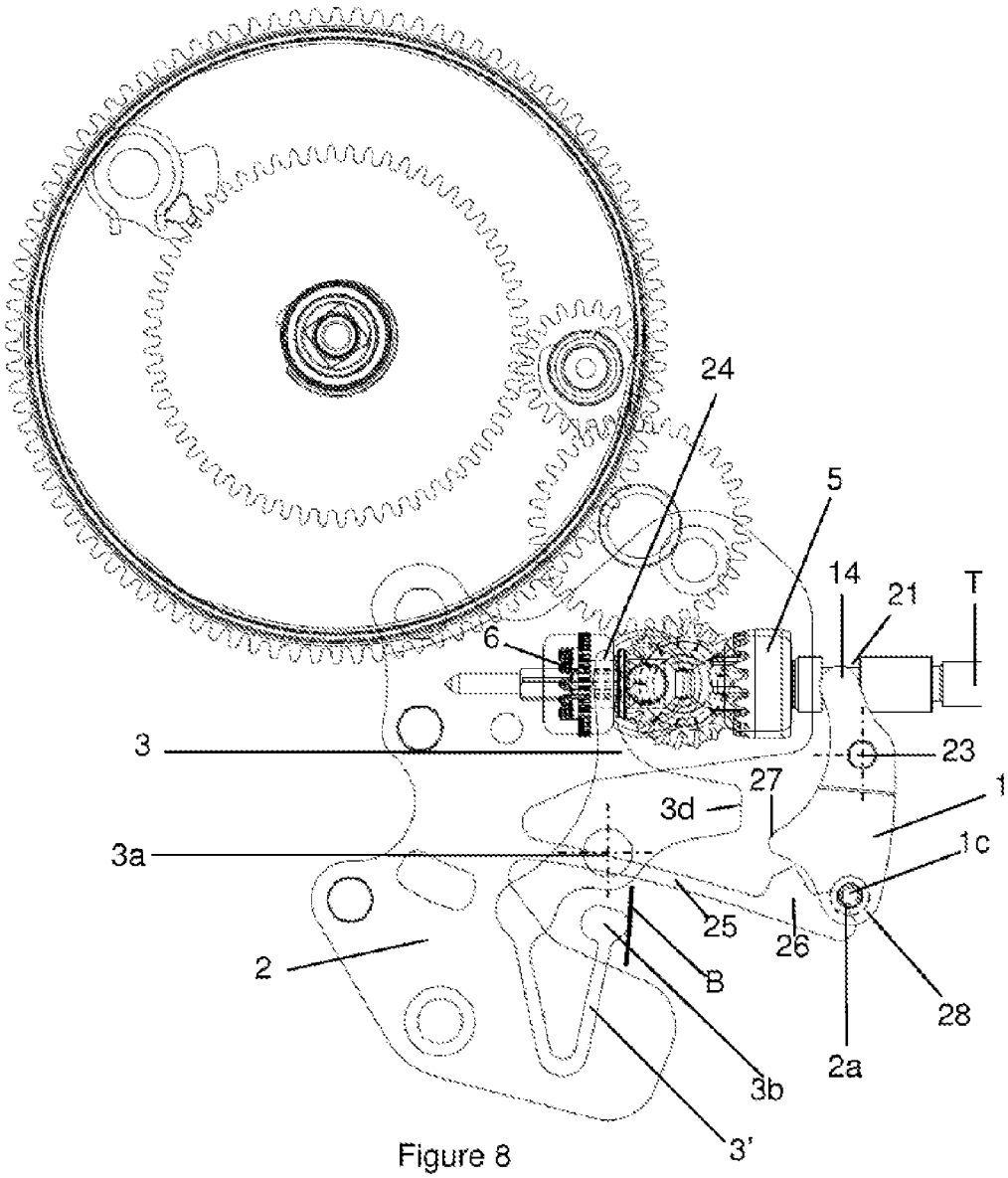
Figure 9:
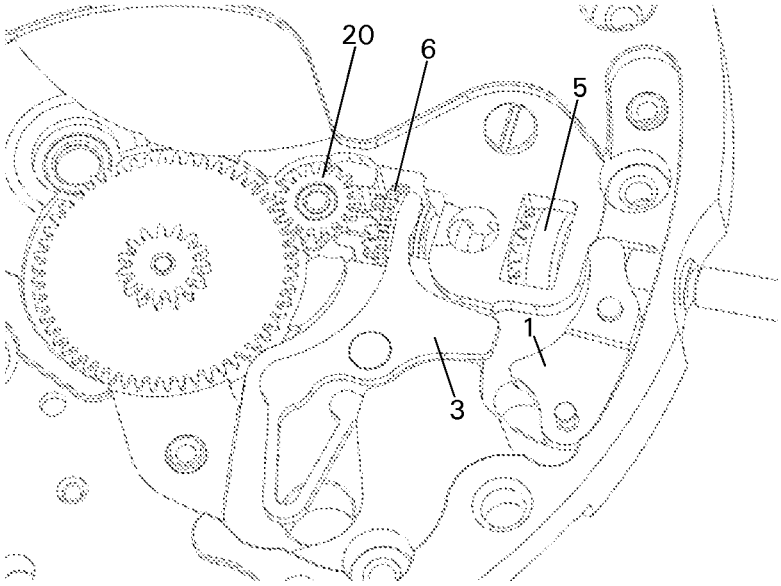
Figure 10:
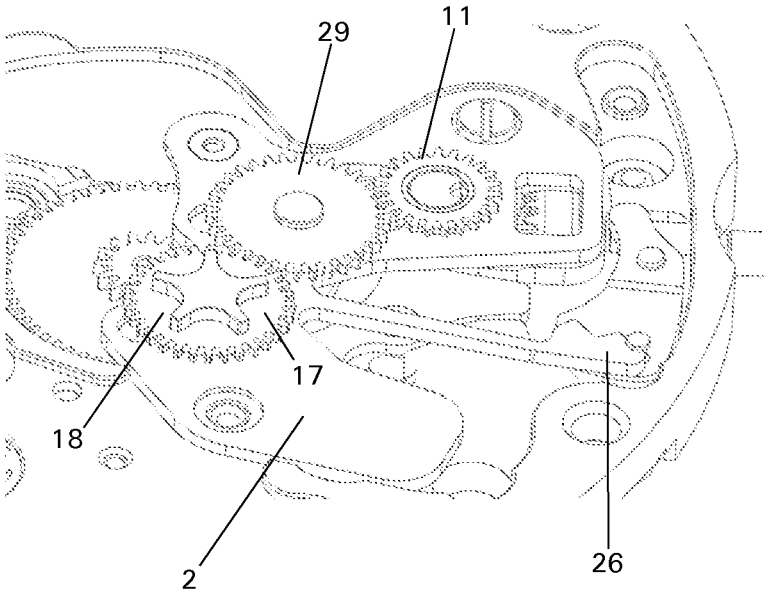
Figure 11:
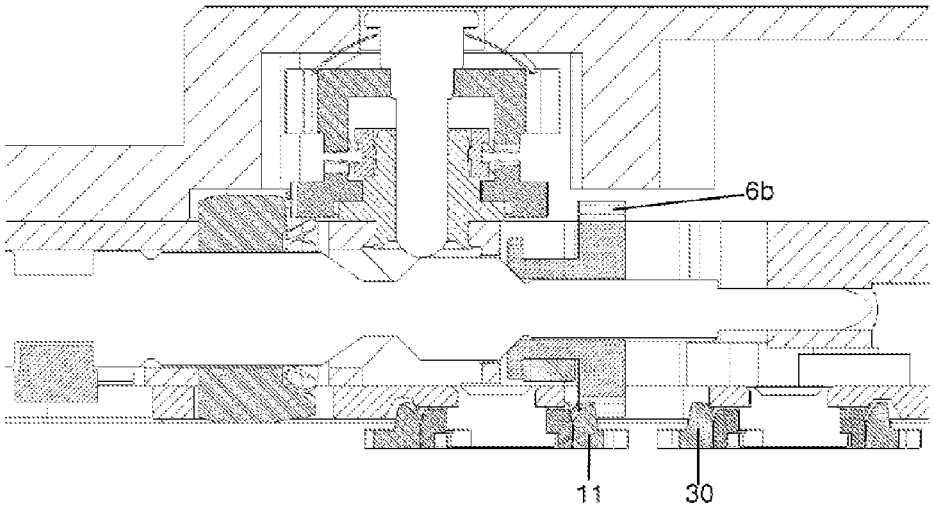
Figure 12:
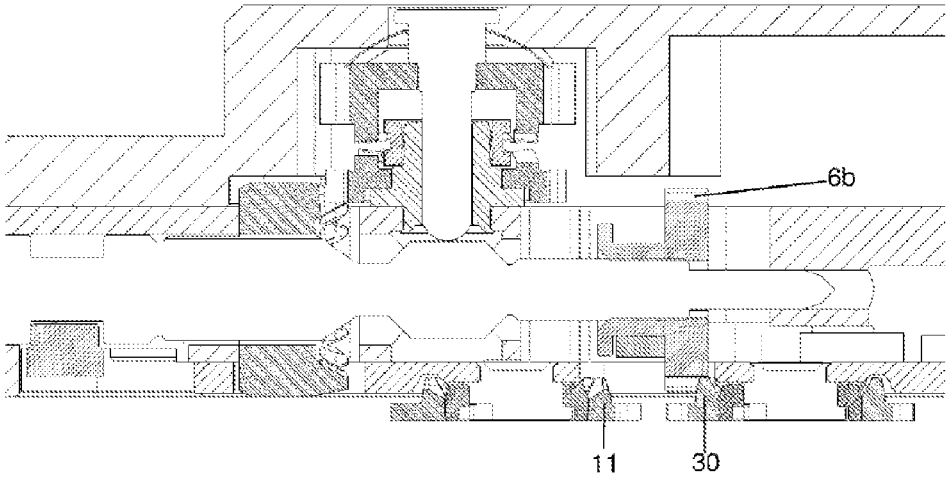

Other features and advantages of the invention will now be described in detail in the following description, which is made with reference to the accompanying figures, in which schematically:

FIG. 1: depicts a part of a timepiece according to the invention, in particular showing the control stem in its first axial position;

FIG. 2: depicts the part of the timepiece in FIG. 1, in particular showing the control stem in its second axial position;

FIG. 3: depicts a partial top view of the timepiece according to the invention, detailing the actuation of the second mechanism;

FIG. 4: depicts a partial top view of the timepiece according to the invention, detailing the driving of a calendar disk;

FIG. 5: depicts a partial top view of the timepiece according to the invention, detailing the driving of the indication of the days of the week;

FIG. 6: depicts the part of the timepiece in FIGS. 1 and 2, showing the control stem in the third position;

FIG. 7: depicts a partial top view of the timepiece according to the invention, detailing the actuation of a third mechanism;

FIG. 8: depicts a partial top view of the timepiece according to the invention, detailing the actuation of the first mechanism;

FIG. 9: depicts a partial top view of a movement of a timepiece according to the invention, before the assembly of a correction module;

FIG. 10: depicts the top view of FIG. 9, after the assembly of the correction module;

FIG. 11: depicts a variant of the timepiece according to the invention, with the control stem in its second axial position; and FIG. 12: depicts the variant of FIG. 11, with the control stem in its third axial position.

DETAILED DESCRIPTION OF THE INVENTION

One embodiment of a horological device, in particular a horological movement or a timepiece, comprises at least two mechanisms, namely, a winding mechanism and at least one mechanism for correcting at least one indicator member.

Described in the following parts of the description is a horological device comprising three mechanisms, all three of these mechanisms being capable of being actuated separately by the control stem.

A person skilled in the art will, of course, be able to draw from the following description the information necessary for the realization of a horological device according to the invention comprising only two mechanisms.

By way of example, the aforementioned three mechanisms may be defined as follows:

first mechanism: winding mechanism;

second mechanism: mechanism for the correction of at least one indicator member, for example a mechanism for the correction of the calendar and of the day of the week, and third mechanism: second mechanism for the correction of at least one other indicator member, for example a mechanism for setting the hour.

First Mechanism: Winding Mechanism

This mechanism is actuated by a vertical coupling-clutch such as that depicted in FIG. 1.

This vertical coupling-clutch comprises a sliding arbor arranged substantially perpendicularly to the longitudinal axis of symmetry of the control stem T, in such a way that it exhibits a lower axial extremity 100 in contact with the control stem T.

In FIG. 1, this control stem T is in its first axial position. The lower axial extremity 100 is then present in a concavity C formed by a reduction in the diameter of the control stem T.

Integrally mounted on the side of the upper axial extremity 13 of the sliding arbor 10 is a first crown wheel 8 provided on one lower surface with Breguet teeth 8*b* intended to engage with Breguet teeth 7*b* provided on an upper surface of a second crown wheel 7 mounted in a freely rotatable manner about the sliding arbor 10.

This second crown wheel 7 also comprises contrate teeth 7*a*, which are substantially perpendicular to its Breguet teeth 7*b* and are continually in engagement with the front teeth 5*a* of a winding pinion 5 mounted on the control stem T, in a fixed rotational connection with the latter and capable of displacement axially on the latter although translationally fixed with regard to the frame of the horological device, thanks to its non-circular cross section which interacts with the non-circular cross section of a portion Z of the control stem T.

The first crown wheel 8 is in engagement with a traditional winding mechanism, such as that represented in FIG. 8, with which a person skilled in the art will be very familiar, and which accordingly does not require to be described here in detail.

A return spring 9 is arranged at the upper axial extremity 13 of the sliding arbor 10 in such a way as to push the latter towards the control stem T and in so doing to press the first crown wheel 8 towards the second crown wheel 7.

The concavity C of the control stem T is bounded on one of its sides by an inclined or frustoconical surface 12 permitting the sliding arbor 10, when the control stem T is drawn in the direction F towards the exterior of the housing of the timepiece, to be displaced in a direction distancing it from the control stem T against the force of the return spring 9.

This distance situation corresponds to the second position of the control stem T, which is represented in FIG. 2.

It can be appreciated from this FIG. 2 that the lower axial extremity 100 of the sliding arbor 10 is now situated on a portion Tr of the control stem T with a larger diameter. It can also be appreciated that the first crown wheel 8 and the second crown wheel 7 are no longer in engagement with one another.

This means that, if the control stem T is turned, the winding pinion 5 and the first crown wheel 7 will also rotate, although the second crown wheel 8 is no longer driven and the winding mechanism, too, for that matter.

Second Mechanism: Mechanism for the Correction of the Calendar and of the Day of the Week This mechanism is actuated when the control stem is in its second position. It can thus be seen in FIG. 2.

A sliding pinion 6 capable of axial displacement on a part of the control stem T and comprising, at the level of one and the same axial extremity, both front teeth 6*a* and contrate teeth 6*b*, can be appreciated from this figure.

Arranged on one side of the timepiece, opposite that on which the sliding arbor 10 is situated, is an intermediate wheel 11, of which the axis of rotation is substantially parallel to the longitudinal axis of symmetry of the sliding arbor 10. This intermediate wheel 11 exhibits front teeth 11*b* intended to engage with the contrate teeth 6*b* of the sliding pinion 6. Given that the latter is in a fixed rotational connection with the control stem T, rotation of the latter can thus cause the intermediate wheel 11 to rotate.

Since this intermediate wheel 11 is likewise provided with contrate teeth 11*a*, it is capable in turn of causing other wheels to rotate, in particular those of a traditional correction mechanism intended for the setting of one or a plurality of time indications, with which a person skilled in the art will be very familiar, and which accordingly does not require to be described here in detail. For example, it may be a device for correcting the calendar and the day of the week, as depicted in FIGS. 3, 4 and 5.

As can be appreciated in particular in FIG. 3, the contrate teeth 6*b* of the sliding pinion 6 mesh with the intermediate wheel 11, which in turn meshes with another intermediate wheel 29, which is in engagement with a correction gear train 15.

This correction gear train 15 interacts with a friction spring 16 in such a way that it positions itself in the direction of rotation imparted to the intermediate wheel 29 by the control stem T.

In the example depicted in FIG. 4, the correction gear train 15 is positioned in order to drive the calendar disk Q in a manner that is known per se by means of a star 17.

In the example depicted in FIG. 5, the correction gear train 15 is positioned in order to drive the day of the week disk J in a manner that is known per se by means of a wheel 18.

With further reference to FIG. 2, it can be appreciated that the sliding pinion 6 exhibits an end surface 19 at an axial extremity opposite that on which the teeth 6*a* and 6*b* are located.

This end surface 19 is intended to abut an abutment surface S situated to the side of the portion Tr opposite that on which the inclined surface 12 is present (FIGS. 1 and 2).

The portion Tr of the control stem T exhibits an axial length intended to ensure that, when the stem is in its first axial position, that is to say when the sliding arbor 10 is in the concavity C, the contrate teeth 6*b* are unable to mesh with the teeth 11*b* of the intermediate wheel 11 (FIG. 1).

On the other hand, the axial length of the portion Tr is such that, when the stem is positioned in its second axial position (FIG. 2) and when the sliding arbor 10 is supported on this portion Tr, the abutment surface S, while still serving as an abutment with the end face of the pinion 6, permits the contrate teeth 6*b* of the pinion 6 to mesh with the teeth 11*b* of the intermediate wheel 11 and retains the pinion 6 in this meshing situation.

Third Mechanism: Mechanism for Setting the Hour

This mechanism is actuated when the control stem T is drawn further towards the outside and arrives in its third position. This case is represented in FIG. 6.

The lower axial extremity 100 of the sliding arbor 10 is then still supported on the portion Tr, in the present example, substantially half-way between the frustoconical surface 12 and the abutment surface S.

For reasons which will be explained below, the sliding pinion 6 then slides by distancing itself from the portion Tr of the control stem T in order to move closer to the extremity of the latter in the direction of the center of the movement. The front teeth 6*a* of the sliding pinion 6 then mesh with an intermediate wheel 20 in engagement with a traditional mechanism for correcting the hour, with which a person skilled in the art will be very familiar, partially visible in FIG. 7, and which does not require to be described here in detail.

Transition from One Mechanism to the Other

The transition of the actuation of one mechanism to the actuation of another mechanism is obviously controlled by the axial displacement of the control stem T.

However, and more precisely, it is controlled on one hand directly by the axial displacement of the control stem T, and on the other hand indirectly by means of a horizontal coupling-clutch that is likewise controlled by the axial displacement of the control stem T and which, unlike the devices of the prior art, causes the deployment of only a single lever arranged in a plane parallel to that of the frame of the horological device. This mechanism will now be explained in detail.

As can be appreciated in FIGS. 1 and 2, the control stem T exhibits a groove 21.

A groove 22 is likewise provided between the axial extremity of the sliding pinion 6 where the teeth 6*a*, 6*b* are present and the opposite axial extremity where the end face 19 is present.

With reference to FIG. 8, it will be appreciated that the groove 21 is intended to receive the extremity 14 of a setting lever 1 pivoting about an axis 23, comprising a finger 27 and equipped with a stud 1*c* at another extremity 28.

The groove 22 on the sliding pinion 6 is intended to receive the extremity 24 of a lever 3 pivoting about an axis 3*a*, exhibiting a nose 3*d* and a part 3' in the form of a 'V', in such a way as to realize a spring, the extremity 3*b* of which is supported against an abutment B for the movement. This spring provides a force that is transmitted to the extremity 24 and then to the sliding pinion 6 in order to push the latter towards the portion Tr of the control stem T.

A jumper 2 is attached to the movement. It has an elastic arm 25 terminated by a nose 26 comprising three flanks 2*a*, 2*b* and 2*c* intended to interact in a manner that is known per se with the stud 1*c* of the setting lever 1.

When the control stem T is in its first position, as depicted in FIGS. 1 and 8, the flank 2*a* is supported on the stud 1*c* of the setting lever 1, and the extremity 14 of the latter resists the force applied by the part 3' of the lever 3 transmitted by the extremity and pressing the end face 19 against the abutment surface S of the control stem T. The torque produced by the elastic arm 25, which is substantially greater than that produced by the spring 3', ensures the retention of the control stem T in its first axial position.

In this position, the sliding pinion 6 does not engage any wheel train.

Consequently, when the user causes the control stem T to rotate manually, the front teeth 6*a* and the contrate teeth 6*b* of the sliding pinion 6 rotate in empty space, whereas the winding pinion 5 drives the first crown wheel 8 by means of the second crown wheel 7, thereby actuating the winding mechanism alone.

When the control stem T is drawn in the direction F towards its second position, as depicted in FIG. 2, the lower axial extremity 100 of the sliding arbor 10 slides on the frustoconical surface 12 and moves away, in so doing separating the first and second crown wheels 8, 7 and disengaging the winding mechanism as a result.

At the same time, as can be appreciated in FIG. 3, the rotation of the setting lever 1 permits the stud 1*c* to come into contact with the flank 2*b* of the nose 26 of the jumper. This ensures the retention of the control stem T in its second axial position.

Furthermore, under the effect of the force exerted by the part 3' constituting a spring, the sliding pinion 6 is pushed in the direction F and remains in abutment against the abutment surface S (see FIG. 2). Thus, when the control stem T is drawn in the direction F towards its second position, the rotation of the lever 3 and the translation of the pinion 6 in the direction F are not directly actuated by the setting lever 1, but by the part 3' of the lever 3 constituting a spring. Contact between the setting lever 1 and the lever 3 is thus not necessary when the control stem T passes from its first position towards its second position.

In this position, its contrate teeth 6*b* mesh with the intermediate wheel 11. When the user then causes the control stem T to rotate manually, the front teeth 6*a* of the sliding pinion rotate in empty space, whereas the contrate teeth 6*b* drive the intermediate wheel 11, thereby actuating solely the mechanism for adjusting the calendar or the day of the week, depending on the direction of rotation of the stem T, as can be appreciated from FIGS. 3, 4 and 5.

If the user now draws the control stem T further in the direction F towards its third position visible in FIGS. 6 and 7, rotation of the setting lever 1 will cause its finger 27 to come into contact with the nose 3*d* of the lever 3, thereby causing the latter to rock against the force of its spring part 3' and as a result distances the sliding pinion 6 from the abutment surface S of the control stem T and thus from the intermediate wheel 11, subsequently disengaging the mechanism for setting the calendar and the day of the week. Thus, when the control stem T is drawn in the direction F towards its third position, the rotation of the lever 3 against the force of its spring part 3' and the translation of the pinion 6 towards the center of the movement are directly actuated by the setting lever 1. Contact between the setting lever 1 and the lever 3 is necessary, therefore, when the control stem T passes from its second position towards its third position.

At the same time, the stud 1*c* of the setting lever 1 comes into contact with the flank 2*c* of the nose 26 of the jumper 2. This ensures the retention of the control stem T in its third axial position.

Furthermore, the form and the dimensioning of the lever 3 are intended to ensure that its extremity 24 received in the groove 22 positions the sliding pinion 6 accurately in order to cause its front teeth 6*a* to come into engagement with the intermediate wheel 20, in so doing actuating solely the mechanism for adjusting the hour, which can be seen partially in FIG. 7.

VARIANT EMBODIMENTS

In FIGS. 1, 2 and 6, the abutment surface S of the control stem T is a frustoconical surface, and the end face 19 of the sliding pinion 6 comprises two parts, these being a part perpendicular to the axis of symmetry of the control stem T and a frustoconical part matching the surface S.

As a variant, the abutment surface S could be perpendicular to the longitudinal axis of symmetry of the control stem T, and the end face 19 of the sliding pinion 6 could be constituted solely by a single part perpendicular to the axis of symmetry of the control stem T.

In FIGS. 1, 2 and 6, the concavity C of the control stem T is defined on one side by the frustoconical surface 12 and on the other side by another frustoconical surface. However, the latter could well be perpendicular to the axis of symmetry of the control stem T because, unlike the frustoconical surface 12, it is not intended to be traversed by the lower axial extremity 100 of the sliding arbor 10.

According to one advantageous embodiment of the invention, the jumper 2 and the correction wheel train belonging to the second mechanism (wheels 11, 29, correction gear train 15, star 17, friction spring 16, calendar disk Q, day of the week disk J, etc.) form a correction module which can be assembled separately on the movement, as can be appreciated in FIGS. 9 and 10, which represent the movement respectively before and after installation of the correction module.

According to a variant represented in FIG. 11 ($2^{nd}$ axial position of the stem) and 12 ($3^{rd}$ axial position of the stem), the driving of the third mechanism effected by means of the front teeth 6*a* of the sliding pinion 6 and of the intermediate wheel 20 is replaced by driving effected by means of an intermediate wheel 30 which is situated substantially on the same plane as the intermediate wheel 11. The sliding pinion 6 then also meshes with this intermediate wheel 30 via its contrate teeth 6*b*, and the front teeth, which are now no longer required, have been removed. Consideration can also be given, of course, to retaining the front teeth with a view to the actuation of a fourth mechanism.

It is, of course, also possible to exchange the second and the third mechanisms.

Whatever the variant or the envisaged embodiment, the transition from the winding position to the rapid correction position takes place in the absence of the risk of blockage, even if the winding train is under tension.

There is also no risk of satellization of the correction wheel train possibly being induced by the translation of the sliding pinion when the stem is drawn from the first to the second axial position, which could possibly cause an unintentional correction.

The sliding pinion 6 is initially positioned under the influence of the spring part 3' of the lever 3, and the rotation of the control stem T permits the meshing between the contrate teeth 6*b* and the teeth 11*b* of the intermediate wheel 11 to be established definitively, independently of the setting lever 1.

On no account is the position of the sliding pinion 6 forced by the user during the transition into the second axial position of the control stem T. There is accordingly no risk of over-center interference between the teeth 6*b* of the sliding pinion 6 and the teeth 11*b* of the intermediate wheel 11, and thus no risk of passing directly from the second position to the third axial position of the control stem T in the event of the user being encouraged to overcome a possible over-center interference.

Thus, the horological device according to the invention allows the known problems associated with the mechanisms belonging to the prior art to be resolved by means of a single lever arranged in the plane of the movement. In addition, this lever possesses the advantage of being suitable both as a mechanism with two positions and as a mechanism with three positions, which permits a design that is simpler and more rational than that of the mechanisms that are familiar from the prior art. The differentiation between these mechanisms may be made during the assembly of the correction gear train and the jumper nose 26 that defines the positions of the control stem T (see FIGS. 9 and 10).

A vertical coupling-clutch comprises a first wheel and a second wheel. These first and second wheels are in a fixed rotational connection with one another, at least when the coupling-clutch is active. Each of these wheels meshes respectively with a driving wheel of a kinematic gear train and with a driven wheel of this kinematic gear train, at least when the coupling-clutch is active. The vertical coupling-clutch comprises an element that is translationally movable, according to the axis of rotation of the first and second wheels, between a first position and a second position. The first position corresponds to the engaged position, and the second position corresponds to the disengaged position. A return element returns the movable element into the first position or into the second position. In the first position of the movable element, the first and second wheels are in a fixed rotational connection, and the first and second wheels each mesh respectively with the driving wheel of the kinematic gear train and with the driven wheel of the kinematic gear train. In the second position of the movable element, the first and second wheels are not in a fixed rotational connection, and/or the first wheel does not mesh with the driving wheel of the kinematic gear train and/or the second wheel does not mesh with the driven wheel of the kinematic gear train.

In a first embodiment of a coupling-clutch, in the second position of the movable element, the first and second wheels are not in a fixed rotational connection. For example, this may be realized thanks to front teeth of the first and second wheels, said teeth being defined in such a way that they are discoupled, when the wheels are moved apart from one another.

In a second embodiment of a coupling-clutch, in the second position of the movable element, the first wheel does not mesh with the driving wheel of the kinematic gear train and/or the second wheel does not mesh with the driven wheel of the kinematic gear train. For example, this may be realized by an axial displacement of one of the wheels or both of the wheels, said displacement being such that at least one of the wheels no longer meshes with the driving wheel or with the driven wheel. In one variant embodiment, the first and the second wheel may be amalgamated.

The expression "vertical coupling-clutch" is thus used to denote a coupling-clutch comprising a wheel and an element that is movable translationally, according to the axis of rotation of the wheel, between a first position and a second position, the first position corresponding to the engaged position, and the second position corresponding to the disengaged position. The axis of rotation of the wheel may, in particular, be substantially perpendicular to the plane of the frame of the timepiece. The axis of rotation of the wheel may likewise be substantially parallel to the plane of the frame of the timepiece.

The invention claimed is:

1. A horological device, comprising:

a winding mechanism, at least one correction mechanism for correcting at least one indicator member, and a control stem, wherein the at least one correction mechanism is capable of being actuated by the control stem, and wherein the control stem can occupy at least two axial positions, each of the two axial positions corresponding to the actuation of one of the winding and correction mechanisms, the control stem being equipped with:

a winding pinion that can engage with a first of the winding and correction mechanisms, and can be moved axially with respect to the control stem but is in a fixed translational connection with the frame of the horological device, and a sliding pinion that can be moved axially, both with respect to the control stem and with respect to the frame of the horological device, and can engage with at least a second of the winding and correction mechanisms, the winding pinion being in a fixed rotational connection with the control stem.

2. The horological device as claimed in claim 1, in which the sliding pinion is in a fixed rotational connection with the control stem.

3. The horological device as claimed in claim 1, in which the sliding pinion exhibits contrate teeth capable of engaging with the second mechanism.

4. The horological device as claimed in claim 1, in which the first mechanism is actuated by a coupling-clutch.

5. The horological device as claimed in claim 4, in which the coupling-clutch is a vertical coupling-clutch or a coupling-clutch that is perpendicular to the longitudinal axis of symmetry of the control stem.

6. The horological device as claimed in claim 4, wherein the coupling-clutch comprises a sliding arbor arranged so as to exhibit a lower axial extremity in contact with the control stem, wherein the control stem comprises a concavity formed by a reduction in the diameter thereof, so that the sliding arbor is capable of being displaced axially by the control stem, and wherein the sliding arbor is integral with a first crown wheel in connection with the first mechanism.

7. The horological device as claimed in claim 6, in which the first crown wheel is capable of being driven in rotation by a second crown wheel engaging continuously with the winding pinion.

8. The horological device as claimed in claim 7,
wherein the control stem comprises a portion situated between the concavity and the sliding pinion, and
wherein the control stem comprises a surface that acts as an axial abutment for the sliding pinion.

9. The horological device as claimed in claim 6,
wherein the control stem comprises a portion situated between the concavity and the sliding pinion, and
wherein the control stem comprises a surface that acts as an axial abutment for the sliding pinion.

10. The horological device as claimed in claim 9, in which the control stem is dimensioned so that, when the control stem occupies a second axial position, the surface retains the sliding pinion in engagement with the intermediate wheel in engagement with the second mechanism.

11. The horological device as claimed in claim 9, in which the control stem is dimensioned so that, when the free lower axial extremity of the sliding arbor is present in the concavity, the surface prevents the sliding pinion from coming into engagement with an intermediate wheel in engagement with the second mechanism.

12. The horological device as claimed in claim 11, in which the control stem is dimensioned so that, when the control stem occupies a second axial position, the surface of the control stem retains the sliding pinion in engagement with intermediate wheel in engagement with the second mechanism.

13. The horological device as claimed in claim 1, additionally comprising a third mechanism that is capable of being actuated by the control stem.

14. The horological device as claimed in claim 13, in which the third mechanism is capable of being driven by the sliding pinion.

15. The horological device as claimed in claim 13, in which the sliding pinion exhibits contrate teeth capable of engaging with the second mechanism, and the third mechanism is capable of being driven by the contrate teeth of the sliding pinion.

16. The horological device as claimed in claim 13, in which the third mechanism is capable of being driven by front teeth provided on the sliding pinion.

17. The horological device as claimed in claim 13, in which a transition from the second mechanism to the third mechanism takes place by a single lever.

18. The horological device as claimed in claim 13, in which the first mechanism is the winding mechanism, the second mechanism is a first mechanism for correcting at least one first indicator member, and the third mechanism is a second mechanism for correcting at least one second indicator member.

19. The horological device as claimed in claim 18, in which the second mechanism is a mechanism for setting at least one of a calendar and a day of a week, and the third mechanism is a mechanism for setting an hour.

20. The horological device as claimed in claim 18, in which the second mechanism is a mechanism for setting a time zone, and the third mechanism is a mechanism for setting an hour.

21. The horological device as claimed in claim 1, in which a transition from the first mechanism to the second mechanism takes place by a single lever.

22. The horological device as claimed in claim 1, in which the first mechanism is the winding mechanism and the second mechanism is the mechanism for correcting at least one first indicator member.

23. The horological device as claimed in claim 22, in which the first indicator member indicates one of (i) a calendar, (ii) a day of a week, (iii) an hour, and (iv) a time zone.

24. The horological device as claimed in claim 1, in which the correction mechanism is a correction module which is assembled separately on the horological device.

25. A method of manufacturing the horological device as claimed in claim 24, comprising assembling the correction module on a movement of a timepiece.

26. A horological device, comprising:
a winding mechanism and
at least one correction mechanism for correcting at least one indicator member, and
a control stem,
wherein the at least one mechanism is capable of being actuated by the control stem,
wherein the control stem can occupy at least two axial positions, each of the two axial positions corresponding to the actuation of one of the winding and correction mechanisms, the control stem being equipped with:
a winding pinion that can engage with a first of the winding and correction mechanisms, the winding pinion being in a fixed rotational connection with the control stem, and
a sliding pinion that can be moved axially, both with respect to the control stem and with respect to the frame of the horological device, and can engage with at least a second of the winding and correction mechanisms,
wherein the first mechanism is actuated by a coupling clutch, the coupling clutch comprising a sliding arbor arranged so as to exhibit a lower axial extremity in contact with the control stem,
wherein the control stem comprises a concavity formed by a reduction in the diameter thereof, so that the sliding arbor is capable of being displaced axially by the control stem, and
wherein the sliding arbor is integral with a first crown wheel in connection with the first mechanism.

27. The horological device as claimed in claim 26, in which the first crown wheel is capable of being driven in rotation by a second crown wheel engaging continuously with the winding pinion.

28. The horological device as claimed in claim 26,
wherein the control stem comprises a portion situated between the concavity and the sliding pinion, and
wherein the control stem comprises a surface that acts as an axial abutment for the sliding pinion.

29. The horological device as claimed in claim 28, in which the control stem is dimensioned so that, when the free lower axial extremity of the sliding arbor is present in the concavity, the surface prevents the sliding pinion from coming into engagement with an intermediate wheel in engagement with the second mechanism.

30. The horological device as claimed in claim 28, in which the control stem is dimensioned so that, when the control stem occupies a second axial position, the surface retains the sliding pinion in engagement with the intermediate wheel in engagement with the second mechanism.

* * * * *